US006901858B2

(12) United States Patent
Koppelkamm

(10) Patent No.: US 6,901,858 B2
(45) Date of Patent: Jun. 7, 2005

(54) PLATE CYLINDER OF A PRINTING PRESS

(75) Inventor: Günter Koppelkamm, Neuensalz (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/680,456

(22) Filed: Oct. 7, 2003

(65) Prior Publication Data

US 2004/0237819 A1 Dec. 2, 2004

(30) Foreign Application Priority Data

May 27, 2003 (DE) ..... 103 24 330

(51) Int. Cl.[7] ..... B41L 21/00

(52) U.S. Cl. ..... 101/415.1; 101/376; 101/246; 101/407

(58) Field of Search ..... 101/415.1, 376, 101/246, 407

(56) References Cited

U.S. PATENT DOCUMENTS

| | | | | |
|---|---|---|---|---|
| 3,103,169 A | | 9/1963 | Taylor | |
| 3,858,512 A | * | 1/1975 | Simeth | 101/415.1 |
| 4,893,561 A | * | 1/1990 | Grosshauser et al. | 101/382.1 |
| 5,284,093 A | | 2/1994 | Guaraldi et al. | |
| 6,443,066 B2 | * | 9/2002 | Stellberger | 101/415.1 |

FOREIGN PATENT DOCUMENTS

| | | |
|---|---|---|
| DD | 39 774 | 7/1964 |
| DD | 72 271 | 4/1970 |
| DE | 40 34 494 | 3/1992 |
| DE | 42 40 333 | 8/1996 |
| DE | 43 30 023 | 11/2001 |
| DE | 43 41 430 | 11/2002 |
| EP | 0 167 861 | 5/1989 |
| EP | 1 155 837 | 4/2001 |
| JP | 03233252 | 9/1991 |

* cited by examiner

*Primary Examiner*—Andrew H. Hirshfeld
*Assistant Examiner*—Andrea H. Evans
(74) *Attorney, Agent, or Firm*—Cohen, Pontani, Lieberman & Pavane

(57) ABSTRACT

A plate cylinder of a printing press, with a tensioning channel which extends in the axial direction, in which means for fixing the plate ends of at least one printing plate which can be positioned on the plate cylinder are arranged. The leading plate end can be fixed by a holding element against a contact surface by means of a tensioning rail which can be moved in the tensioning channel. After that, and after the plate cylinder has been rotated, it is then possible to hook the trailing plate end on the extended tensioning rail. After that, it is possible to draw the tensioning rail back in again to tension the trailing plate end.

14 Claims, 6 Drawing Sheets

17
25
24
23
13
4
6
22
14
12
5
21
26
A 17
27
24
14
22
4
6
12
5
23
21
13
26
B.C

PLATE CYLINDER OF A PRINTING PRESS

BACKGROUND OF THE INVENTION

1. Field of the Invention

The invention relates to a plate cylinder of a printing press having an axially extending plate channel and means for fixing the leading and trailing ends of at least one printing plate in the channel.

2. Description of the Related Art

U.S. Pat. No. 6,439,117 shows a device for fastening flexible printing plates to the plate cylinder, which device comprises a clamping device arranged in the cylinder body and a segmented pressure bar arranged outside the plate cylinder, this one clamping device clamping all the printing plates. A disadvantage is that the clamping device releases the ends of all the printing plates when one printing plate is changed, and for this reason, when the one printing plate is to be changed, the other printing plates which are not to be changed have to be pressed onto the plate cylinder by means of the segmented pressure bar and held, so that the ends of the printing plates which are not to be changed do not slide out of the tensioning channel.

SUMMARY OF THE INVENTION

The invention is based on the object of creating a plate cylinder of a printing press which tensions the printing plates using simple means.

According to the invention, a tensioning rail in the channel carries a holding element and is movable transversely to the axial direction between an extended position and a drawn-in position.

It is significant that the tensioning rail is arranged so as to be movable in the tensioning channel in such a way that the leading plate end can be fixed by a holding element against a contact surface by means of the tensioning rail which can be moved into a first position. After this it is possible, after the plate cylinder has been rotated, to hook the trailing plate end on the tensioning rail, which has been extended into a second position. After this it is possible to draw the tensioning rail back in again to a third position to tension the trailing plate end.

A further advantage is that the tensioning rail can be tensioned by a spring element in the movement direction of the tensioning-rail movement, so that the tensioning force is introduced in the region of the plate-fixing means.

It is possible to actuate or activate each individual tensioning rail and thus each individual printing plate from the control desk by means of the push rod which is configured with different regions (control elevations) or a control profile. An automatic or semi-automatic plate-tensioning device can be achieved by means of an adjusting device provided for the push rod.

It is significant that at least one permanent gap for inserting the plate ends is present for the respective tensioning device in the cylinder on the circumference. It is of advantage that the printing forme is not damaged during the change, ensuring its multiple use. The interaction of the holding elements during the printing-forme change with the contact surfaces in the tensioning channel makes a narrow channel gap possible at the circumference of the plate cylinder, which is beneficial to the printing process under the aspect of minimizing channel jolts. The channel width is preferably less than 3.5 millimetres. It is worth mentioning that the cylinder body is not weakened by the narrow tensioning channel and there is only a slight risk of contaminating the tensioning rails or the whole device for fastening flexible printing formes.

It is important that two tensioning rails can be activated by means of a push rod in the case of a once-round plate cylinder. This makes it possible to lessen the weakening of the once-round cylinder by dividing the functions.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

they are merely intended to conceptually illustrate the structures and procedures described herein.

DETAILED DESCRIPTION OF THE PRESENTLY PREFERRED EMBODIMENTS

Figure 1:
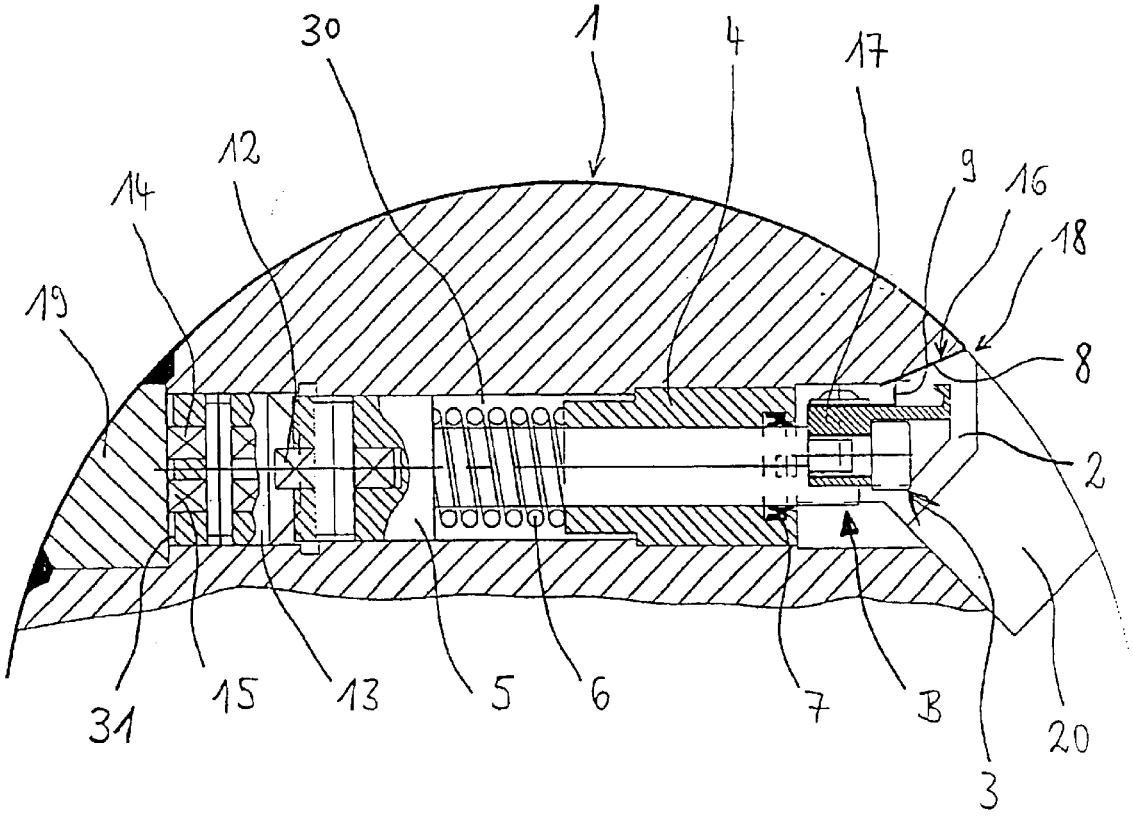
FIG. 1 shows a cross section through a device having a printing forme fastened to a plate cylinder.

FIG. 1 shows part of a plate cylinder 1 having a cut-out 2 which extends in its longitudinal direction and can be a channel-like milled-out section, in which a clamping device 3 is arranged. The clamping device 3 has a guide element 4 which is fastened in a bore 30. A plunger 5 is displaceably mounted in the guide element 4, the plunger 5 being pressed inwards by a compression spring 6 arranged on the guide element 4. A tensioning rail 17 is arranged on at least one plunger 5. At least one tensioning rail 17 is required per printing plate. A wiping element 7 is arranged on the guide element 4, in order to wipe off dirt adhering to the plunger 5. A holding element 9 is arranged on the tensioning rail 17 for clamping a leading plate end 8. The holding element 9 is, for example, a leaf spring. The holding element 9 configured as a leaf spring can also be replaced by an appropriate shaped surface on the tensioning rail 17. A holding element 11 is arranged on the tensioning rail 17 in order to accommodate a trailing plate end 10 (cf. FIG. 2). The plunger 5 has a roller element 12, which can run on a push rod 13. The push rod 13 is displaceably guided by means of roller elements or sliding elements 14, 15 in the forme cylinder 1 in a cut-out 31, which can be a channel-like milled-out section. FIG. 1 shows the insertion and clamping, which have already taken place, of the leading plate end 8. Here, the plunger 5 is in a position B. The tensioning rail 17 is situated in the clamping position in the position B. The push rod 13 has no influence on the plunger 5 in the position B (cf. FIG. 5), as the roller element 12 cannot run on the push rod 13 on account of the spacing. In position B, the plunger 5 and the tensioning rail 17 are pressed inwards by means of the compression spring 6, and the leading plate end 8 is pressed by the holding element 9 against a contact surface 16 on the plate cylinder 1. Here, the leading plate end 8 can be configured with an angled-over edge 28 which is angled over at an acute angle. The contact surface 16 is designed to extend obliquely inwards in accordance with the angled-over edge 28 of the plate end 8, in order to produce as large a contact area as possible and to make a form-fitting and/or force-transmitting connection possible between the contact surface 16 and plate end 8. It is only necessary to clamp the plate end 8 by means of the holding element 9 in this way if the trailing plate end 10 is not yet fixed in position. It is thus possible to fasten the printing forme to the plate cylinder 1 reliably and accurately while a printing forme is being changed. The channel-shaped cut-out 31 is closed with a filler piece 19 in the region of the push rod 13. For this purpose, the filler piece 19 is closed with the cylinder body of the plate cylinder 1. The filler piece 19 is preferably screwed or welded to the cylinder body of the plate cylinder 1. The cut-out 2 is closed with a filler piece 20 in the region of the tensioning rail 17 in such a way that a tensioning channel 18 is formed which accommodates the plate ends 8, 10. In the region of the cylinder surface, the tensioning channel 18 is configured with a small gap which is preferably less than 3.5 millimetres wide, the tensioning channel 18 widening in the direction of the tensioning rail 17, in order to ensure that the holding elements 9, 11, the tensioning rail 17 and the plunger 5 can move.

Figure 2:
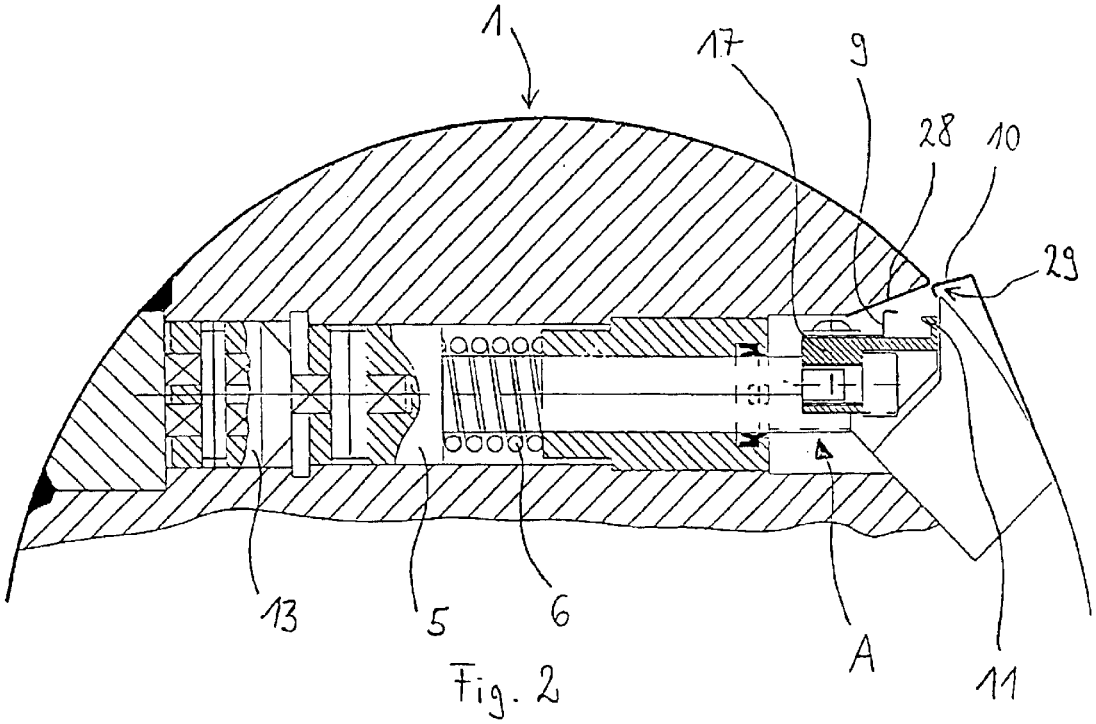
FIG. 2 shows the device according to FIG. 1 while a trailing edge of the printing forme is being inserted into a tensioning channel of the forme cylinder.

FIG. 2 shows the trailing plate end 10 pivoting into the tensioning channel 18, the plunger 5 is situated here in a position A. In the position A, the tensioning rail 17 is situated in the release position. The trailing plate end 10 is pressed into the holding element 11 by an operator or an automatically actuated pressure roller. The holding element 11 can be configured as a shaped element which interacts, with a form-fitting and/or force-transmitting connection, with a plate end 10 which is preferably configured with an angled-over edge 29.

Figure 5:
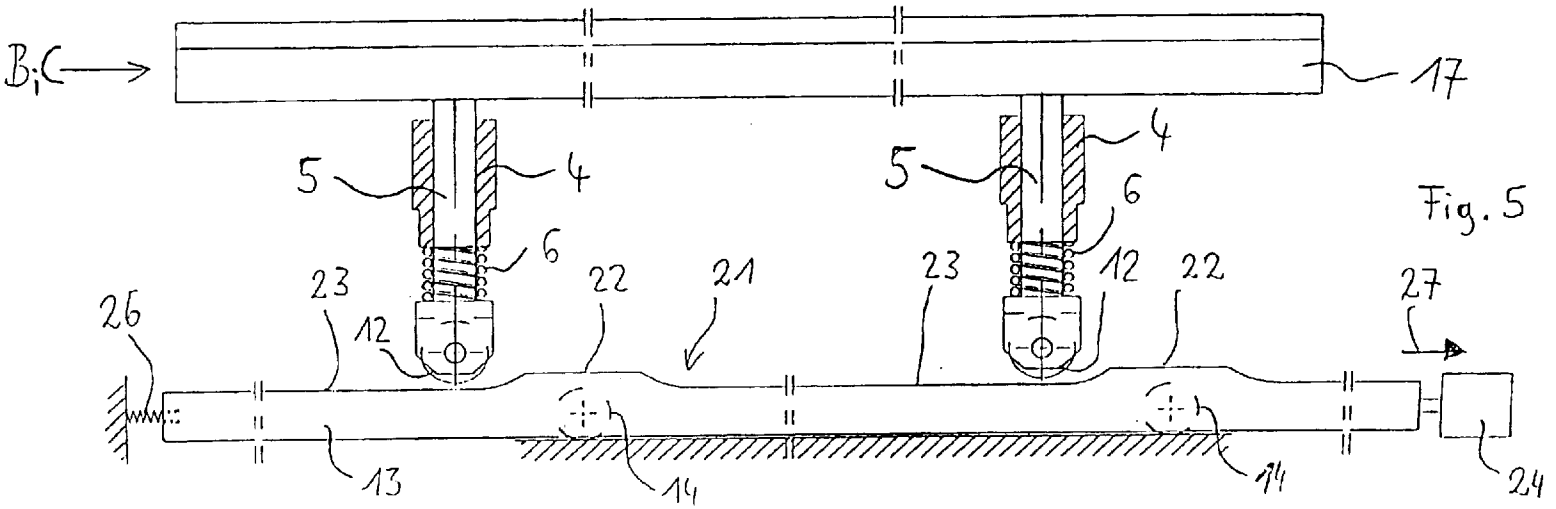
FIG. 5 shows the movement mechanism according to FIG. 4 in position B or C.

FIG. 5 shows how the tensioning rail 17 is moved into the position A. The push rod 13 is configured, on its side towards the plungers 5, with a control profile 21 which has elevations 22 and depressions 23. In order to move the tensioning rail 17 into the position A, the push rod 13 is displaced axially in the direction 25 by means of an adjusting device 24 or manually. During the axial displacement, the push rod 13 runs in a guided manner on the cylinder body or on the filler piece 19 by means of its rollers or sliding elements 14, 15, and is pressed against a compression spring 26 arranged on the end. During the displacement of the push rod 13, the rollers 12 of the plungers 5 engage with the elevation 12. The plungers 5 are deflected counter to the force of the compression springs 6 and the tensioning rail 17 is positioned in the radial direction into the position A.

It is possible to accommodate the adjusting device 24 in the plate cylinder 1. If no adjusting device 24 is arranged in the plate cylinder 1, it is possible to actuate the push rod 13, after rotating the cylinder into an appropriate position, by means of an external adjusting apparatus 24 which is arranged on the end and can be driven by hand or by means of a pneumatic or hydraulic drive.

In an equivalent manner, it is possible (not shown in greater detail) to use a radially movable element, for example a shaft equipped with cams, as an alternative to the axially displaceable push rod 13.

Figure 3:
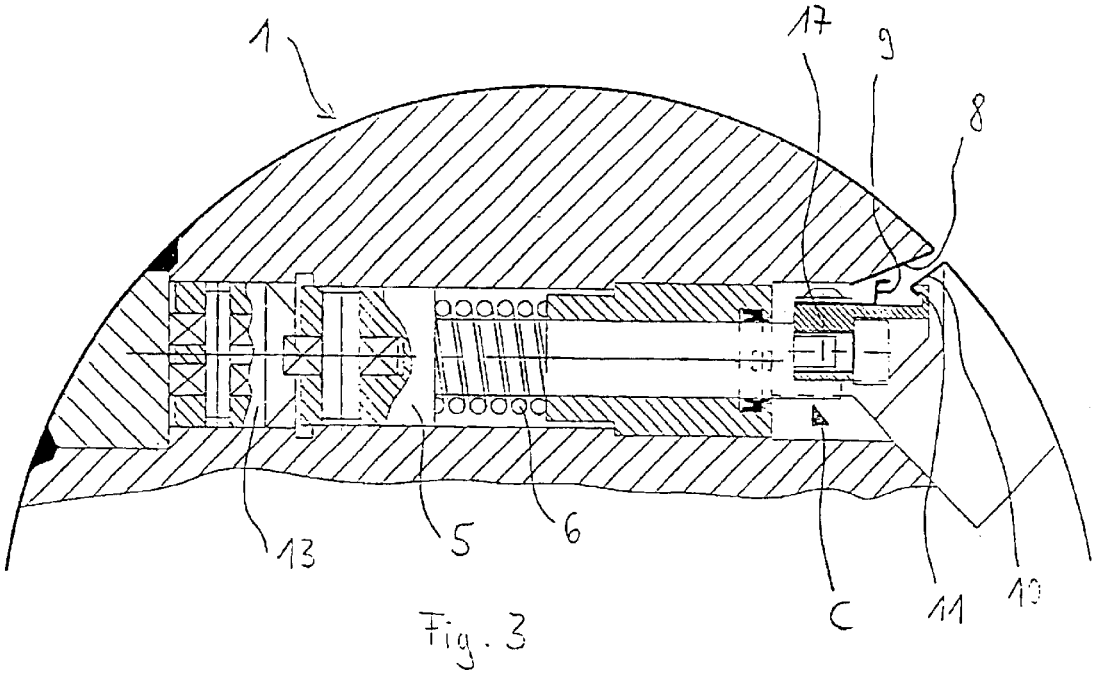
FIG. 3 shows the device according to FIG. 1 before the inserted second end of the printing forme is clamped in the tensioning channel.
Figure 4:
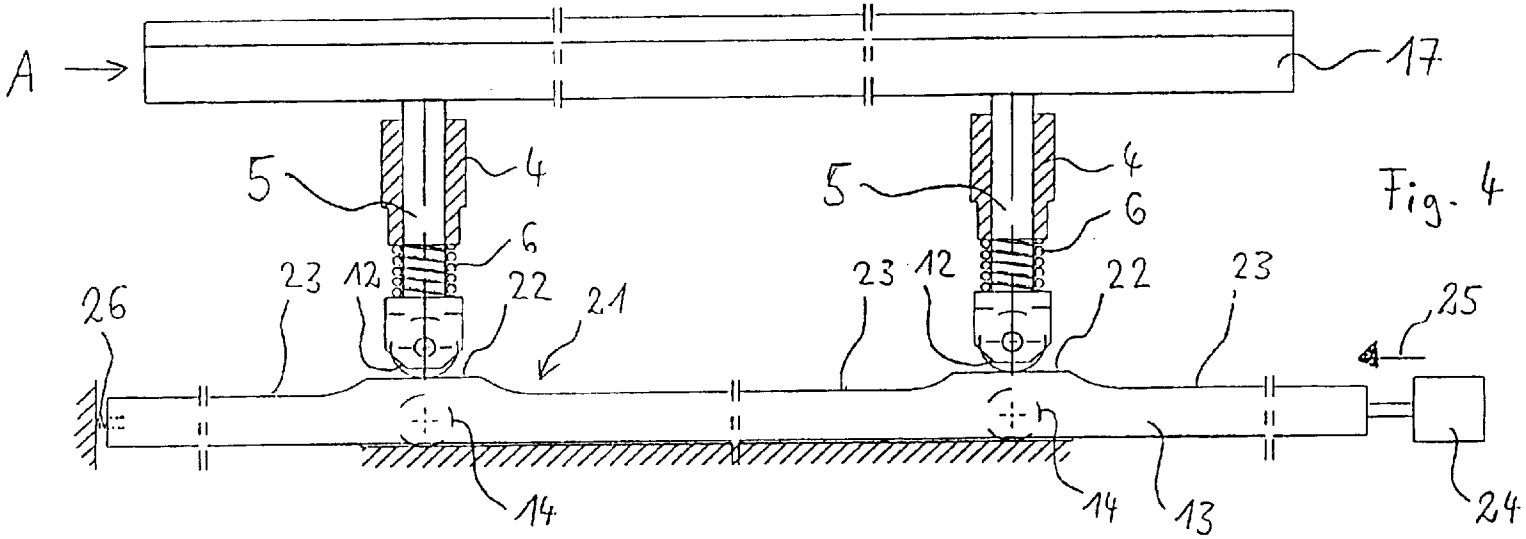
FIG. 4 shows a movement mechanism for the device according to FIG. 1 in position A.

FIG. 3 shows the tensioning of the trailing plate end 10; the plunger 5 is moved back into a position C for tensioning purposes. In the position C, the tensioning rail 17 is situated in the tensioning position. FIG. 4 shows how the tensioning rail 17 is moved into the position B or into the position C. In order to move the tensioning rail 17 into the position A, the push rod 13 is displaced axially in the direction 27 by means of the adjusting device 24 or manually. During the axial displacement, the push rod 13 runs in a guided manner on the cylinder body or on the filler piece 19 by means of its rollers or sliding elements 14, 15, and is pressed back by the compression spring 26 arranged on the end. During the displacement of the push rod 13, the rollers 12 of the plungers 5 no longer engage with the push rod 13, but lie in the region of the depressions 23 and can spring out freely. The plungers 5 are deflected in the direction of the depressions 23 by the force of the pretensioned compression springs 6, and the tensioning rail 17 is positioned in the radial direction into the position B or into the position C. The trailing plate end 10 is thus drawn into the tensioning channel 18 by the holding element 11 or by the tensioning rail 17, and the printing plate is tensioned around the cylinder circumference, the leading plate end 8 being drawn against the contact surface 16 on the plate cylinder 1 and thus fixed by the tensioning of the printing forme around the cylinder circumference.

The position B serves for fixing the leading plate end 8 in position during the printing-forme change, the leading plate end 8 being pressed against the contact surface 16 on the plate cylinder 1 by means of the holding element 9.

Figure 8:
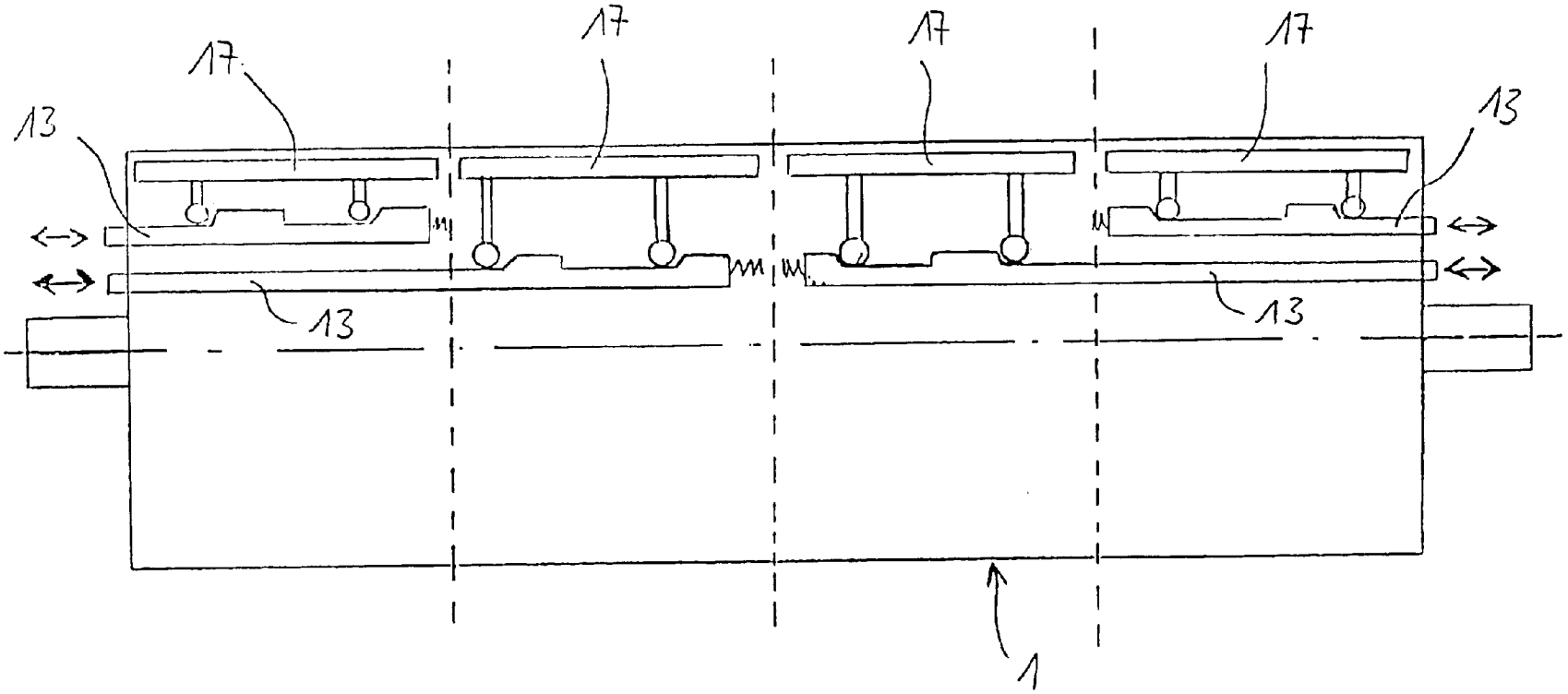
FIG. 8 shows a plate cylinder for four printing plates having tensioning rails, which are each actuated by one push rod.

In each case one push rod 13 is provided per tensioning rail 17 (cf. FIG. 8).

Figure 6:
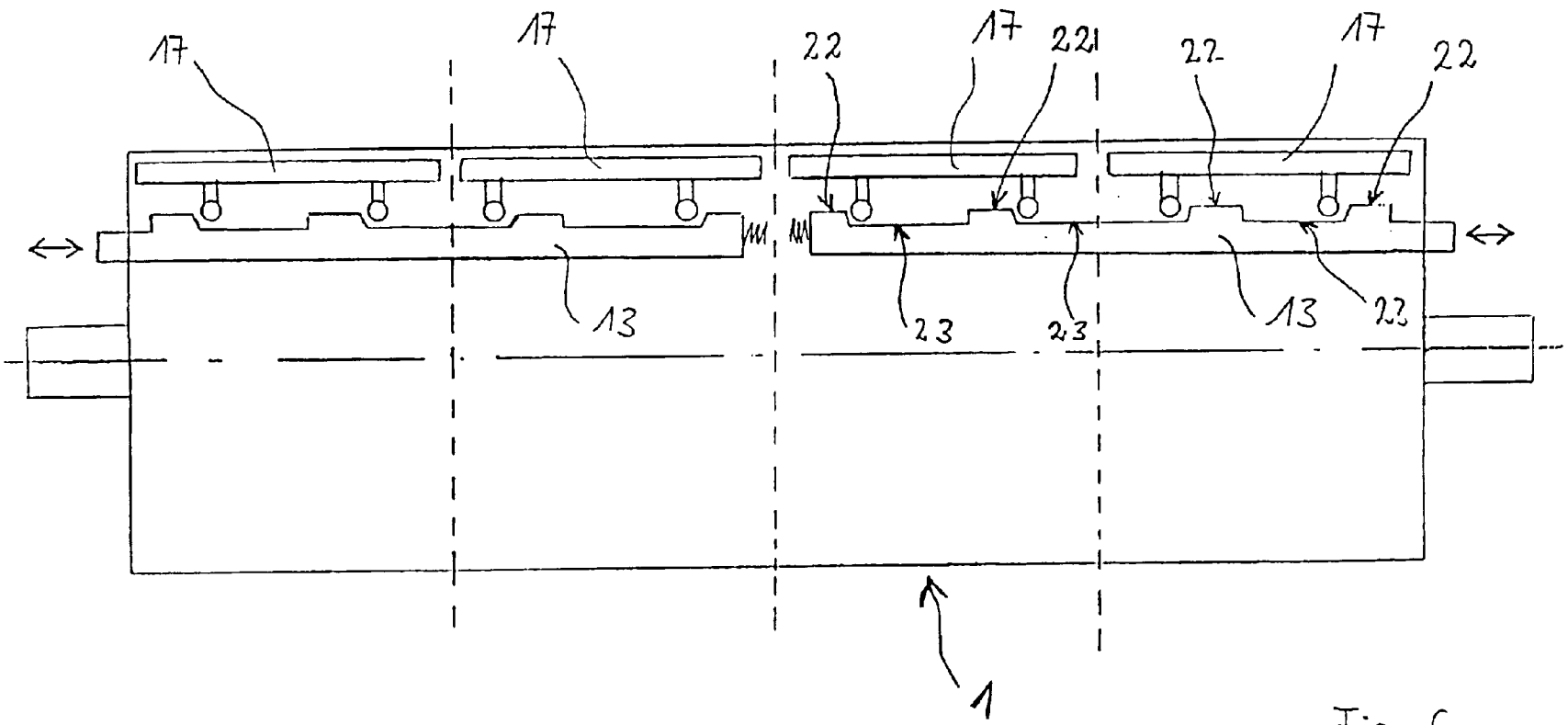
FIG. 6 shows a plate cylinder for four printing plates having tensioning rails, in each case two tensioning rails being actuated by one push rod.
Figure 7:
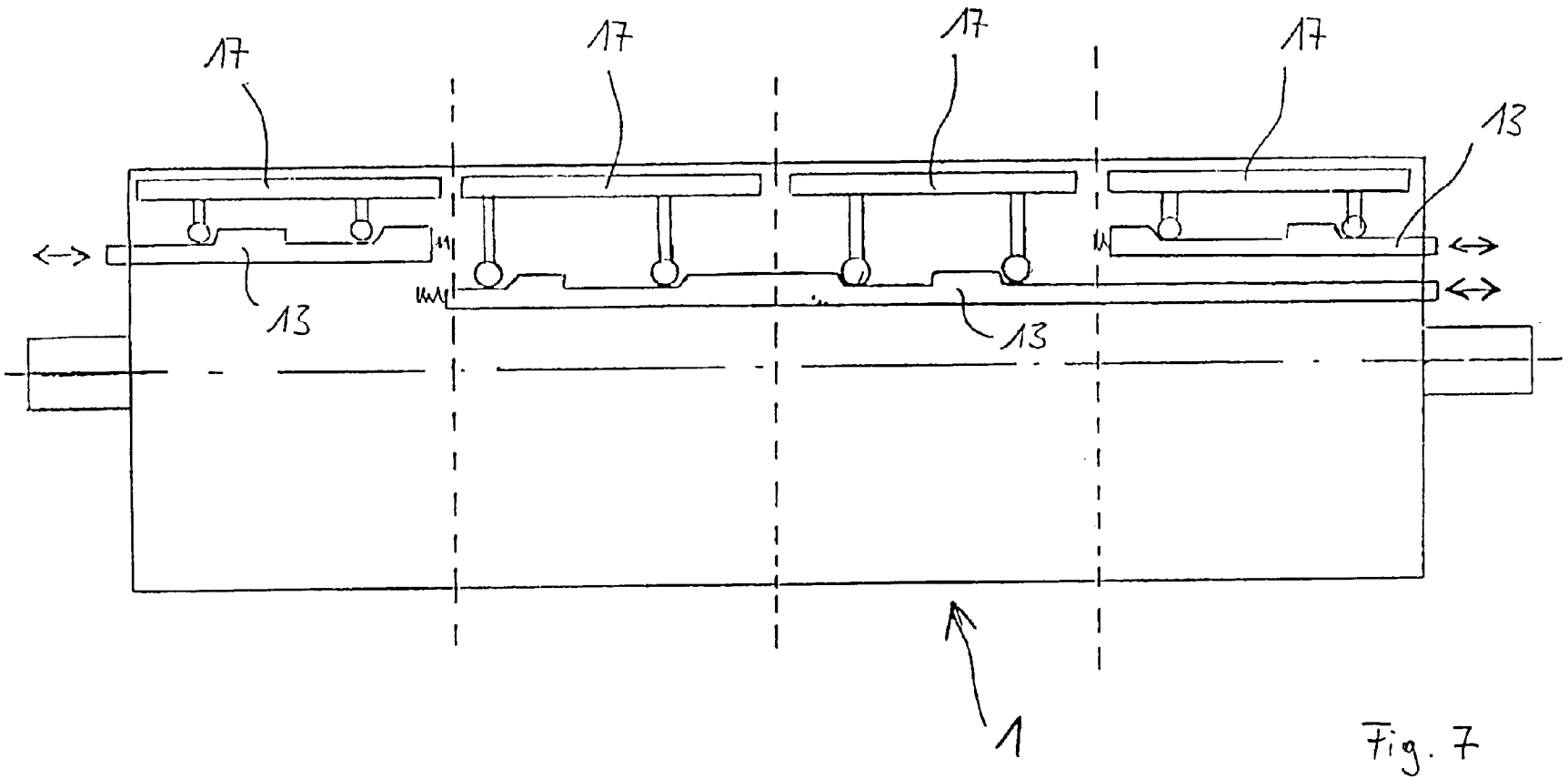
FIG. 7 shows a plate cylinder for four printing plates having tensioning rails, the central tensioning rails being actuated by one push rod and the outer tensioning rails being actuated in each case by one push rod.

In the case of plate cylinders 1 with a small diameter, in each case one push rod 13 can be inserted into the cut-out 2 in each case from one end, the two right-hand tensioning rails 17 being activated by a push rod 13 which can be adjusted from the right-hand end, and the two left-hand tensioning rails 17 being activated by a push rod 13 which can be adjusted from the left-hand end (cf. FIG. 6). In order to independently or individually activate the respective tensioning rails 17 actuated by a push rod 13, the control profiles 21 of the push rod 13 are arranged offset with respect to one another, such that, when one of the tensioning rails 17 is actuated by means of the elevations 22, the tensioning rail 17 which is not to be actuated lies in the region of the depressions 23. In the case of plate cylinders with a relatively large diameter, it is possible to activate the two outer tensioning rails 17 by respective push rods 13, and it is possible to activate the central two tensioning rails 17 either by one push rod 13 (cf. FIG. 7) or by two push rods (cf. FIG. 8).

As an alternative, an axial bore in the region of the push rod 13 is also conceivable instead of the channel-like cut-out 31. The lower filler piece 19 is then omitted.

The printing plate is ejected in such a way that the trailing plate end 10 is released by moving the tensioning rail 17 into position A, and is pushed out by rotating the plate cylinder 1 in reverse gear (counter to the rotational direction during printing). The plate end 10 can be released in such a way that the plate end 10, which is drawn in and clamped for tensioning purposes in position C by means of the tensioning rail 17, is initially tensioned, and the tensioning rail 17 is moved into the position A to release the plate end 10, the plate end 10 slipping out of the holding element 11 and the tensioning channel 18 on account of the force from the tensioning being released. The leading plate end 8 is clamped again immediately after the plate end 10 is released, the tensioning rail 17 being pulled into the position B by means of the release of the spring force of the spring element 6. The operator proceeds to the location and can unhook the leading plate end 8 from the tensioning rail 17 or the clamping channel 18, the tensioning rail 17 being moved into the position A for this purpose. Subsequently, the operator hooks the leading end 8 of the new printing plate into the tensioning channel 18, the tensioning rail 17 is moved into position B in order to clamp the leading plate end 8, and the new plate is drawn in by rotating the plate cylinder 1 in the rotational direction for printing, the tensioning rail 17 being moved into the position A when the trailing end 10 of the new printing plate is hooked in, and the plate end 10 being clamped after it is hooked in by means of moving the tensioning rail 17 into position C, and the printing plate being clamped cleanly and exactly on the cylinder circumference, the holding element 9 in the position C not touching the leading plate end 8 and, by means of the tensioning of the printing forme around the cylinder circumference, the plate end 8 being drawn against the contact surface 16 on the plate cylinder 1 and fixed.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A plate cylinder for carrying a printing plate in a printing press, said printing plate having a leading plate end and a trailing plate end, said cylinder comprising:

a cylinder body having an axis;

a tensioning channel extending in an axial direction in said cylinder body, said channel having a contact surface which said leading plate end can bear against;

a tensioning rail in said channel, said tensioning rail carrying a holding element and being movable transversely to said axial direction between an extended position, where said trailing plate end can be hooked on said rail after said leading plate end has been placed in said channel and said cylinder has been rotated, and a drawn-in position, where said holding element fixes said leading plate end against said contact surface and trailing plate end is tensioned;

at least one spring element which loads said tensioning rail toward said drawn-in position; and a push rod which is displaceable in said axial direction and has cam surfaces which are effective to move said tensioning rail between said positions as said push rod is moved axially.

2. A plate cylinder as in claim 1 further comprising at least one plunger positioned between said push rod and said tensioning rail, said cam surfaces acting on said plungers to move said tensioning rail.

3. A plate cylinder as in claim 1 wherein said contact surface of said tensioning channel is configured to cooperate with a leading plate end configured with an angled-over edge, and said tensioning rail is configured to cooperate with a trailing plate end having a double angled-over edge.

4. A plate cylinder as in claim 1 further comprising an adjusting device for displacing said push rod, said adjusting device having one of a pneumatic drive and a hydraulic drive.

5. A plate cylinder as in claim 1 wherein said push rod has one end which can be connected to said adjusting device, and another end which is supported in said cylinder body by a spring element.

6. A plate cylinder as in claim 1 wherein said tensioning rail, in said extended position, lies within said cylinder body.

7. A plate cylinder as in claim 1 wherein said holding element is a shaped leaf spring.

8. A plate cylinder as in claim 2 wherein said cylinder body has a cut-out which accommodates said tensioning rail, said plunger, and said push rod, said plate cylinder further comprising:

a filler piece which closes said cut-out adjacent to said push rod, and a filler piece which defines the size and shape of said tensioning channel.

9. A plate cylinder as in claim 1 further comprising an end from which said push rod can be actuated.

10. A plate cylinder as in claim 9 further comprising a clamping device accommodated in said tensioning channel, said tensioning rail and said holding element being fixed to said clamping device.

11. A plate cylinder for carrying at least two printing plates in a printing press, each said printing plate having a leading plate end and a trailing plate end, said cylinder comprising:

a cylinder body having an axis;

at least two tensioning rails for respective said printing plates, only one said tensioning rail being provided for each said printing plate, each said tensioning rail being movable between a tensioning position, where the respective printing plate is tensioned on said cylinder body; and a release position, where the respective printing plate can be released from the cylinder body; and at least one movement mechanism for activating said tensioning rails independently of one another, said at least one movement mechanism comprising at least one spring element for each said tensioning rail, said at least one spring element loading the respective tensioning rail toward said tensioning position, and at least one push rod which is displaceable in an axial direction, said at lease one push rod having cam surfaces which are effective to move said tensioning rails between said positions as said at least one push rod is moved axially.

12. A plate cylinder as in claim 11, wherein said tensioning rails are aligned in an axial direction in said cylinder body.

13. A plate cylinder as in claim 11 comprising:

a single push rod having a first set of cam surfaces which are effective to move one of said tensioning rails between said positions, and a second set of cam surfaces which are effective to move another of said tensioning rails between said positions.

14. A plate cylinder as in claim 11 comprising:

a separate push rod for each of said tensioning rails.

* * * * *